US008888199B2

(12) United States Patent
Vogl et al.

(10) Patent No.: US 8,888,199 B2
(45) Date of Patent: Nov. 18, 2014

(54) STORAGE DEVICE FOR OUTDOORS

(76) Inventors: Thomas Vogl, München (DE); Markus Scholz, München (DE); Jens Armbrüster, Seeheim-Jungenheim (DE)

( * ) Notice: Subject to any disclaimer, the term of this patent is extended or adjusted under 35 U.S.C. 154(b) by 0 days.

(21) Appl. No.: 13/582,307

(22) PCT Filed: Dec. 20, 2010

(86) PCT No.: PCT/EP2010/070270

§ 371 (c)(1),
(2), (4) Date: Nov. 8, 2012

(87) PCT Pub. No.: WO2011/107177

PCT Pub. Date: Sep. 9, 2011

(65) Prior Publication Data

US 2013/0047527 A1 Feb. 28, 2013

(30) Foreign Application Priority Data

Mar. 3, 2010 (DE) ..... 20 2010 003 042 U

(51) Int. Cl.
*A47B 81/00* (2006.01)
*E04H 1/12* (2006.01)

(52) U.S. Cl.
CPC ..... *E04H 1/1205* (2013.01)
USPC ..... 312/310; 52/79.7; 52/79.2; 52/79.3

(58) Field of Classification Search
CPC ..... B25H 1/12; B25H 3/021; B25H 3/028
USPC ..... 312/310; 52/79.1, 79.2, 79.3, 79.7, 106, 52/236.4, 236.7
See application file for complete search history.

(56) References Cited

U.S. PATENT DOCUMENTS

| | | | | |
|---|---|---|---|---|
| 1,512,694 | A | | 10/1924 | Kallnbach |
| 2,679,444 | A | | 5/1954 | Lloyd |
| 4,050,215 | A | * | 9/1977 | Fisher ..... 52/79.3 |
| 4,375,306 | A | * | 3/1983 | Linder ..... 312/249.9 |
| 4,433,883 | A | * | 2/1984 | Boender et al. ..... 312/234.1 |
| 4,478,467 | A | * | 10/1984 | Tyndall ..... 312/249.9 |
| 4,483,573 | A | * | 11/1984 | Keller ..... 312/281 |
| 5,259,668 | A | | 11/1993 | Teufel et al. |
| 5,718,398 | A | | 2/1998 | Ross, Jr. |

(Continued)

FOREIGN PATENT DOCUMENTS

| | | |
|---|---|---|
| CA | 2 558 979 A1 | 3/2007 |
| CA | 2558979 | 3/2007 |

(Continued)

*Primary Examiner* — William Gilbert
*Assistant Examiner* — Alp Akbasli
(74) *Attorney, Agent, or Firm* — Maier & Maier, PLLC

(57) ABSTRACT

In order to store equipment and tools in the smallest space with at the same time improved access possibilities and orderliness in outdoor areas, a storage means is described for outdoor areas comprising: at least two holding compartments (11), each of which has one or a plurality of closable opening sections (13), wherein the one opening section (13) or the plurality of opening sections (13) jointly, which belong to the same holding compartment (11), have a surface that essentially corresponds to a surface of an outer side of this holding compartment (11), and wherein the opening sections (13) are arranged on at least two adjacent sides of the storage means.

18 Claims, 7 Drawing Sheets

(56) References Cited

U.S. PATENT DOCUMENTS

| | | | | |
|---|---|---|---|---|
| 5,743,701 | A * | 4/1998 | Green | 414/498 |
| 6,915,657 | B1 * | 7/2005 | Wood | 62/371 |
| 6,935,641 | B2 * | 8/2005 | Hahn | 280/47.19 |
| 6,966,350 | B1 * | 11/2005 | Gist | 144/285 |
| 7,059,819 | B2 * | 6/2006 | Brackmann et al. | 414/462 |
| 7,249,700 | B1 * | 7/2007 | Watson et al. | 225/34 |
| 7,284,393 | B1 | 10/2007 | Macmillan | |
| 7,338,055 | B2 * | 3/2008 | Fuentes | 280/79.3 |
| 7,489,509 | B2 * | 2/2009 | Keenan et al. | 361/700 |
| 7,714,708 | B2 * | 5/2010 | Brackmann et al. | 340/539.1 |
| 7,746,634 | B2 * | 6/2010 | Hom et al. | 361/679.53 |
| 7,850,258 | B2 * | 12/2010 | Hupke | 312/108 |
| 7,862,341 | B2 * | 1/2011 | Durand et al. | 434/408 |
| 7,882,659 | B2 * | 2/2011 | Gyory et al. | 52/79.5 |
| 7,908,800 | B2 * | 3/2011 | Bach Lahor | 52/142 |
| 8,166,714 | B2 * | 5/2012 | Ziegelman | 52/79.2 |
| 8,210,548 | B1 * | 7/2012 | Agyemang | 280/47.35 |
| 8,276,999 | B2 * | 10/2012 | Hassman et al. | 312/6 |
| 8,347,560 | B2 * | 1/2013 | Gyory et al. | 52/79.5 |
| 2003/0015851 | A1 * | 1/2003 | Hahn | 280/47.24 |
| 2005/0001395 | A1 * | 1/2005 | Fuentes | 280/47.35 |
| 2006/0059792 | A1 * | 3/2006 | Tiramani | 52/79.1 |
| 2006/0145574 | A1 * | 7/2006 | Hung | 312/249.11 |
| 2006/0267464 | A1 * | 11/2006 | Wyatt et al. | 312/265.4 |
| 2007/0001561 | A1 * | 1/2007 | Sabo et al. | 312/316 |
| 2007/0029746 | A1 * | 2/2007 | Brennan, Jr. | 280/47.26 |
| 2007/0145870 | A1 * | 6/2007 | Uffner et al. | 312/257.1 |
| 2008/0218038 | A1 * | 9/2008 | Wood et al. | 312/116 |
| 2009/0085448 | A1 * | 4/2009 | Zhang | 312/309 |
| 2009/0134755 | A1 * | 5/2009 | Lakoduk et al. | 312/326 |
| 2009/0224639 | A1 * | 9/2009 | Sosin | 312/223.1 |
| 2010/0201230 | A1 * | 8/2010 | Schweitzer et al. | 312/107 |
| 2011/0062834 | A1 * | 3/2011 | Ball et al. | 312/215 |
| 2011/0084576 | A1 * | 4/2011 | Leatherman | 312/100 |

FOREIGN PATENT DOCUMENTS

| | | |
|---|---|---|
| DE | 202 08 111 U1 | 9/2002 |
| DE | 20208111 U1 | 9/2002 |
| GB | 1489875 | 10/1977 |
| WO | WO 96/328641 | 10/1996 |
| WO | WO9632864 | 10/1996 |

* cited by examiner

STORAGE DEVICE FOR OUTDOORS

The invention relates to a storage means for outdoor areas.

Normally, garden tools and equipment etc. are stored in garden sheds. There is, however, a noticeable increase in housing space density above all in the conurbation areas of Europe. This also affects the traditional middle-class residential areas. The average land area in gardens of estates with terraced and semi-detached housing has been halved over the past 20 years.

Conventional garden sheds have one or at most two accesses to rooms that the user can enter. These rooms are then organised from the inside, i.e. after the user has entered the garden shed he stores objects in the shelves or storage devices located in the rooms. This gives rise to the problem that an interior space must always be kept free so that the garden shed can be entered, and this area is thus no longer available as storage space. In addition, the objects being sought are often obstructed by other objects, and it is then necessary first to rearrange the stored objects before the item being searched for can be located. One further problem is that it is frequently impossible or very difficult to bring large objects through the doors of the garden sheds into the interior area.

SUMMARY

The task of the present invention is therefore to provide a storage means for outdoor areas in which equipment and objects can be stored with minimum use of space while at the same time providing improved means of access, so that the space available can be used optimally. A further task is to create a storage means for outdoor areas that allows the user to organise the stored items more easily.

This task is solved by the features of the independent claim.

The invention is based on the idea of dispensing completely with space for movement within the storage means. Therefore, no space is wasted just so a person is able to move around as is the case in conventional garden sheds, and all unnecessary competition between the need for space to store and space to move is avoided.

In a preferred embodiment example, a storage means for outdoor areas comprises at least two holding compartments that each provide one or more lockable opening sections, wherein the one opening section or the plurality of opening sections jointly, which belong to the same holding compartment, have an area that essentially corresponds to a surface of an outer side of this holding compartment, and the opening sections are arranged on at least two adjacent sides of the storage means.

Because the opening section of a holding compartment extends approximately over the entire outer side of the relevant holding compartment, the placing (or removal) of objects in the holding compartment is greatly facilitated. The objects thus do not have to be lifted over thresholds or rims or manoeuvred through a small opening into a larger room positioned behind. The holding compartment is furthermore more clearly laid out and easier to organise. Because each holding compartment has its own opening section, it is simply to access directly and only the item that is wanted.

In a preferred embodiment example, the storage means has a rectangular or square floor area. The floor area can, however, also have an elliptic or polygon design.

Preferably, horizontal elongations of the holding compartments in a direction parallel to an outer side of the storage means can correspond basically to a length of this outer side of the storage means. It is also possible that the floor areas of the holding compartments, which lie in a horizontal intersecting plane through the storage means, jointly correspond to the floor area of the storage means. In other words, the holding compartments of the storage means can almost completely fill the inner volume of the storage means.

The interior space of the storage means is in this embodiment example almost completely filled by holding compartments, which can, if required, be divided by partition walls or arranged between the support elements. Because the entirely of the holding compartments constitute the volume of the storage means, there is an efficient use of space available without the need for movement room or other dead space.

Preferably, the height, depth and/or width of each holding compartment is independent of the heights, depths and widths of the other holding compartments. Alternately or additionally, at least two holding compartments positioned over each other and whose opening sections are arranged on the same side surfaces of the storage means can have different floor areas. This means that each holding compartment can in its dimensions be set and adjusted flexibly and individually according to requirements.

Specifically, the dimensions of at least one holding compartment can be adjusted to take account of expansion of some object to be stored. In this embodiment example, each holding compartment corresponds to one or more objects. For example, the storage means can provide one separate holding compartment for a watering can, a garden hose, a ladder, a shovel, a wheelbarrow, a lawnmower, a deckchair, a sunshade, refuse containers, skis, surfboards, car tyres, firewood and similar objects. Because each holding compartment corresponds to one object or a type of objects, it is easy to store the items in an orderly fashion. This also means that objects that are rarely used can also be accessed directly and easily, as each object is assigned to a separate holding compartment. In one special design, the holding compartments can be adjusted to fit the products of one manufacturer.

Preferably a width and/or height of a holding compartment can be larger than a depth of this holding compartment. This gives rise to holding compartments with a lower depth, which is an advantage for some objects. For example, such a holding compartment can be arranged as a tool cabinet. When holding compartments or their opening sections are arranged on two neighbouring sides of the storage means, one or more shallow holding compartments can be arranged so that their rear wall at least partially borders a side surface of at least one holding compartment from the neighbouring side of the storage means. The shallow holding compartments can also be used for supplementing or filling out the possibly irregular volume made up of specified or selected holding compartments to form a cuboidal volume of the storage means. This enables optimum use of the available space.

In another embodiment example, at least two holding compartments, whose opening sections are arranged on opposite sides of the storage means, are adjacent to each other with one side surface. In other words, the rear walls of the holding compartments that are accessible from opposite sides of the storage means stand directly opposite each other without any other holding compartment being between them.

In a further preferred embodiment example, three sides of the storage means are provided with opening sections such that at least one holding compartment whose opening section lies on the middle side protrudes between the holding compartments whose opening sections lie on the other sides. Because opening sections are arranged on three sides of the storage means, more space can be made available, and this can nevertheless be accessed easily without any need for room for movement.

Horizontal and/or vertical support elements can be arranged between the holding compartments. In addition, a horizontal distance between vertical support elements can each correspond to a width or/and a depth of at least one holding compartment. These support elements can support, for example, side or rear walls, the ground, ceiling and/or external walls of the holding compartments, or merely serve to stabilise the storage means. These support elements can moreover also be used for fixing shelves etc., and in this way divide a holding compartment.

Alternately to a monolithic arrangement with horizontal and/or vertical support elements, the storage means can also be made up of modules, where each module comprises at least one holding compartment. A modular structure provides the advantage that a user can arrange his storage space according to his individual requirements. He can in this regard freely decide on not only the external dimensions of the storage means but also the dimensions of the individual holding compartments and their arrangement. If, for example, there is a large lawn, storage space can be arranged for a large lawnmower. A smaller lawn area will, however, require only a smaller lawnmower and accordingly also smaller space. The modules can be connected to each other by means of a lock-in system. Lock-in connections allow the modules to be linked easily, and the user will thus be able to make up his storage space easily and arrange it by means of the different modules according to his individual requirements.

In a further alternative embodiment, partition walls, or interior or intermediate walls, that separate the holding compartments from each other, are fixed to a floor area and/or to a ceiling area of the storage means. The floor area and/or the ceiling area can, for example, be provided with recesses or grooves on the inside, into which the partition walls can be shoved. The floor area and/or the ceiling area can here preferably have a plurality of such recesses and/or grooves, which will allow a flexible placement or insertion of the partition walls. Alternately or additionally, the partition walls can also be fixed with mounting elements. Preferably, a clamp-type mounting element with U-shaped cross section such as a staple can be used, into which a partition wall can be inserted or shoved. The mounting element can also be provided with a through-hole through side surfaces facing each other, so that a partition wall inserted in the mounting element can be fixed to the mounting element by a fixing element inserted through the through-hole and the partition wall. The mounting elements can be nailed or screwed into the floor area and/or ceiling area so that they hold the partition walls from below or above at a specified distance from the floor or ceiling. This prevents, in contrast to partition walls positioned flat on each other, the formation of mildew or rotting due to the accumulation of water or dampness in a contact area. It also guarantees improved ventilation of the storage rooms.

External rims of the storage means are possibly stabilised by framework elements. Preferably, a framework element has for this purpose a form with two right-angled trihedrons facing each other and connected to each other with a bracket, such that a framework element can support five different external rims or two neighbouring corners of the storage means. In other words, the framework element can have two L-shaped corner elements positioned opposite each other and with the same alignment, and one rim element that connects the two corner elements at their angle, and is positioned in each case vertical on the areas expanded by the L-shaped corner elements. The brackets of a corner element can have different lengths. Preferably, however, the brackets of the corner elements of the framework element positioned opposite each other will have the same length. In one embodiment example, the framework elements are arranged on the external rims of the storage means such that the one L-shaped corner element is positioned on the ground and the other on the upper side of the storage means, and the rim element runs along a vertical external rim. In this case, a framework element can be positioned on each vertical external rim. The bracket ends of two neighbouring framework elements can be linked by at least one connecting element. When the connecting element has a length corresponding to a length of the rim element of the framework element or to a length of an external rim of the storage means, then both the upper and the lower bracket ends of the two framework elements can be linked to each other with a connecting element. In this case, the connecting element will also contribute to stabilising the framework elements. One cross-sectional form of the connecting element, favoured due to its particular stability, is the T form. The connecting element can also serve to delimit an opening section. For example, the connecting element can present a support area for a closing element and in this way be used as, for example, part of a door frame. The connecting element can moreover also be provided with mounting elements for fixing partition or inner walls. These mounting elements can be formed in clamp-type design, as mentioned above, and a partition wall can therefore then be inserted in the mounting element without any major effort.

According to a further embodiment example, one or more opening sections can be closed one or more closing elements. For example, an opening section can be locked by two doors or by one swing door. A roller shutter can furthermore close several opening sections.

In a further embodiment example, at least one holding compartment can be divided into several sections. For example, a holding compartment can be divided by a drawer, a slide-in board, shelf and/or suspension device.

A holding compartment can have several closing elements on an outer side, wherein the closing elements extend essentially across the entire area of the outer side. A closing element can be formed as door, flap, slide-in front or roller shutter. For example, a holding compartment can be divided into several drawers, wherein the front sides of the drawers form essentially the outer side of the holding compartment.

At least one of the holding compartments can furthermore be accessible from two sides. This represents an advantage in particular with very elongated holding compartments. If, for example, a holding compartment has opening sections on two opposite side surfaces of the storage means, a user can extract an object, for example a ladder, from both sides.

In a further embodiment example, an upper side of the storage means can have at least one opening section. This locker-type design is especially advantageous for low storage systems.

The storage means can furthermore, according to a further embodiment example, be provided on at least one side with a step aid and/or ladder to the opening sections of higher positioned holding compartments. In a very small garden or a small available floor area, the storage means can have a small floor area. In order to provide sufficient storage space, however, the storage means can be installed at a higher level, so that the opening sections are no longer all accessible on ground level, but can be accessed by means of steps or a ladder.

Alternately, the storage means can be designed such that all holding compartments of the storage means can be accessed on ground level.

In addition, an upper side of the storage means can be constructed, according to the user's requirements, as pitched roof, flat roof, pent roof or gabled roof. The additional room that can in this way be created underneath a slanted roof can then serve as closed holding compartment or as open storage space. The upper side of the storage means or the roof can furthermore be turned into a green roof or bed for planting.

The storage means is provided preferably with at least one electrical power supply, for example in the form of a socket. This can be used for powering, for example, a lawnmower or a hedge clippers. The storage means can moreover be provided with at least one solar panel and in this way be generally independent of external power sources. A storage element can also be provided for storing the electrical energy thus generated. In a further embodiment example, the storage means can be provided with a cable connection means that can have a fixed connection to the plug of an electrical appliance. The cable connection means serves, for example, to wind up an extension cable. When the extension cable is required, it can simply be extracted from the cable connection means. After use, all that needs to be done is press a foot pedal or a switch etc., which causes the extension cable to be retracted and rewound automatically into the cable connection means. Difficult and time-consuming rewinding of the cable can in this way be avoided. Alternately, the cable connection means can be released under tensile pressure and rewound when the tensile pressure is relaxed, this avoids cable entanglement or superfluously and unused cable lengths.

According to another embodiment example, a storage means can also have at least one water collection means. The water collection means can, for example, be formed as a rain drain with or without a collection tank. The storage means can also be provided with at least one water connection, water tap and/or integrated garden hose. The integrated garden hose is already connected to a water source and can simply be drawn out and used. The integrated garden hose can after use be rewound when a switch in the storage means is activated.

In a further preferred embodiment, the storage means can be locked by means of a central locking system for several holding compartments and/or at least one local locking system for each holding compartment. The central locking system can open or lock at least two holding compartments in the storage means or the entire storage means when a number combination or password is entered and acts as central access control. This provides security for the objects stored in the storage means and protects them from unauthorised access. The holding compartments can furthermore be opened quickly and easily, without the need for time-consuming opening and closing of the different holding compartments with different keys. The holding compartments can also be individually sealed by a local locking system.

In a further preferred storage means in accordance with the invention, a sound output system is provided that can be connected to a MP3 player. For example, the sound output system for playing music etc. can comprise various interfaces for audio data media, a radio receiver, an integrated amplifier and weatherproof hi-fi loudspeakers.

The storage means according to the invention can also be provided with a lighting system, allowing the surrounding area of the storage means to be given atmospheric lighting by means of, for example, solar lamps or colour LEDs.

In a further preferred embodiment example, the storage means can have at least one play device and/or at least one stall. This play device is to be understood as, for example, a slide, a climbing rope, a swing or a playhouse.

The storage means can also be used as a cabinet device such as a garden shed, but or storage for refuse containers.

DETAILED DESCRIPTION OF THE EMBODIMENT EXAMPLES

The storage means according to the invention serves to store equipment and tools and other objects in outdoor areas with the greatest saving of space. The storage means therefore preferably has the form of a cube or a block that dispenses with the need for internal room for movement. The storage means is for this purpose provided with a plurality of holding compartments, each of which is accessible through at least one opening section and has preferably a rectangular basic design. The opening sections can be provided in two, three, four or in all external surfaces of the storage means.

Because the storage means is intended for outdoor areas, e.g. the garden, an inner yard, etc., it has to be weatherproof and provide protection for the objects stored therein from the effects of weather. It will therefore be realised in weatherproof material, such as wood, metal, stone, plastic, glass or a combination of these materials.

Figure 1:
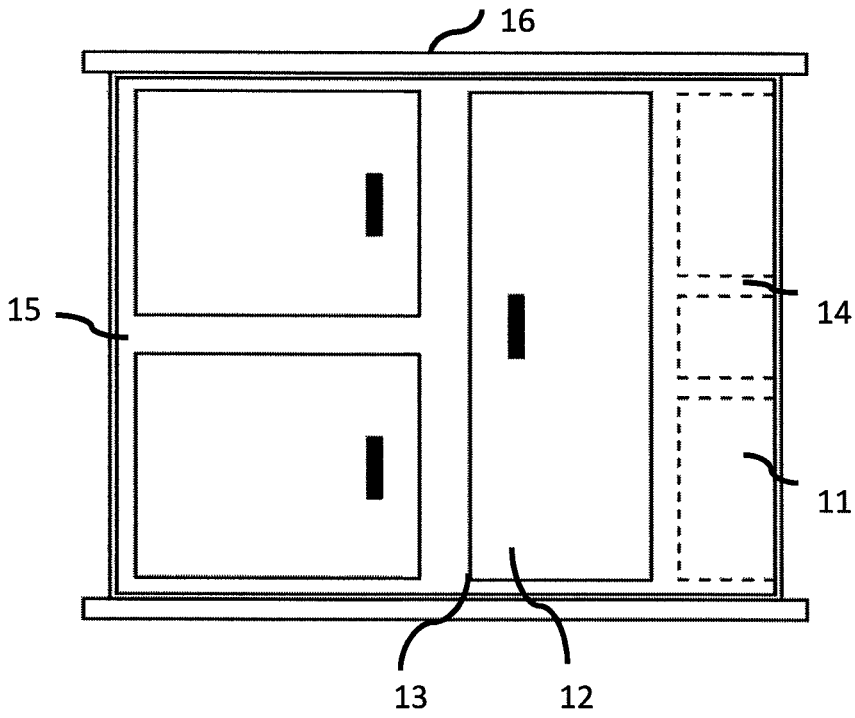
FIG. 1 shows a side view of a storage means according to an embodiment example of the present invention.

FIG. 1 shows a side view of a storage means in an embodiment example according to the invention. The storage means of FIG. 1 shows holding compartments 11 on at least the front and the right-hand side. The holding compartments 11 are each accessible through an opening section 13, realised in an outside side wall 15 of the storage means. The opening section 13 can be opened and locked by a closing element 12, for example by a door, a flap, a roller shutter, the front side of a drawer or a slide-in board, etc. If a door or a flap is planned as closing element 12, a hinge can be positioned at the top, bottom or at the side of the closing element 12 as required. The closing elements 12 can completely cover the opening sections 13, such that an upper side 16 and the side walls 15 together with the closing elements 12 form the external surfaces of the storage means. The closing elements 12 can also be provided with handle elements to facilitate opening and closing.

If an opening section 13 has exactly one closing element 12, the closing element 12 will have approximately the same area as the corresponding opening section 13. Because the area of an opening section 13 preferably corresponds to the area of an outer side of the relevant holding compartment 11, the closing element 12 forms basically the outer side of the corresponding holding compartment 11. It is, however, also possible that an opening section 13 is locked by several closing elements 12, for example by the presence of a plurality of drawers positioned above or beside each other or by two doors. In this case, the overall area of the closing elements 12 corresponds approximately to the area of the outer side of the holding compartment 11. In another case, a closing element 12 can close several opening sections 13. The area of the closing elements 12 will then be the same as the overall area of corresponding opening sections 13. Reference is made here by way of example to a roller shutter that can close opening sections 13 arranged above or beside each other.

The dotted lines in FIG. 1 indicate holding compartments 11 that protrude from the right side wall 15 into the inside of the storage means up to the holding compartments 11 accessible from the front side wall 15. The distance between the opening sections 13 of the holding compartments 11 on the front side wall 15 and a right edge of the storage means in FIG. 1 corresponds therefore to approximately the depth of the holding compartments 11 on the right side wall 15, whose side surfaces border the front side wall 15. A section of a side wall 15 without opening sections 13 therefore corresponds approximately to the side surfaces of holding compartments 11, whose opening sections 13 are positioned on a neighbouring side wall 15 of the storage means. Generally, the three-dimensional dimensions of the holding compartments 11 are independent of each other. The holding compartments 11 are nevertheless designed such that they almost completely fill the interior space of the storage means. The holding compartments 11 in the storage means can furthermore be separated from each other by partition elements 14.

In a preferred embodiment example, each holding compartment 11 is designed so that it can take one or more predetermined objects. The dimensions of the holding compartment 11 correspond for this purpose approximately the side of the object to be stored. The internal volume of a holding compartment 11 is therefore only slightly larger than the object and the object can thus be easily inserted or taken out, without, however, any wastage of superfluous storage room. The storage means can therefore have, for example, a holding compartment 11 for a lawnmower, a holding compartment 11 for flowerpots or a holding compartment 11 for a broom. These holding compartments 11 can furthermore be identified by, for example, writing or symbols. In a special embodiment example, the holding compartments 11 can be adapted to the products of a certain manufacturer.

The interior space of a holding compartment 11 can furthermore by divided by elements such as slide-in shelves, hooks etc., so that several objects of the same type can be stored neatly in a holding compartment 11. Such an inner division can be an advantage in particular in holding compartments 11 for small objects, such as hammer, files, saws, garden shovels and other tools.

Figure 2:
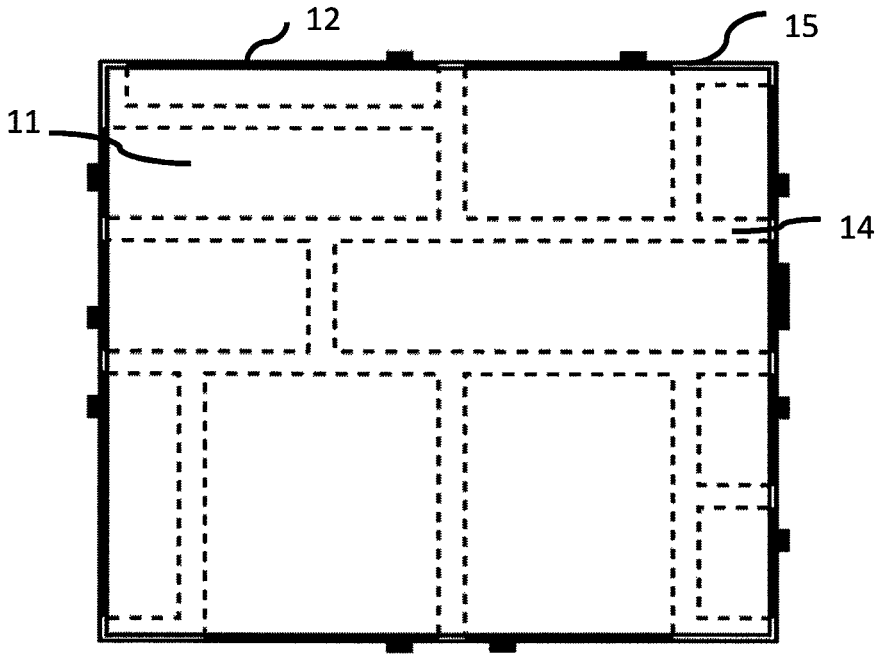
FIG. 2 shows a cross-sectional view of a storage means according to another embodiment example of the present invention.

FIG. 2 shows a cross-sectional view of a storage means according to another embodiment example of the present invention. The storage means in FIG. 2 is provided with opening sections 13 on all four side of the storage means, each of which offers access to a holding compartment 11 behind it. Partition elements 14 divide the interior space of the storage means into holding compartments 11, while one partition element 14 can also consist only of an intermediate space between the holding compartments 11. It is clear from FIG. 2 that the interior space of the storage means is filled almost completely by holding compartments 11.

Figure 3A:
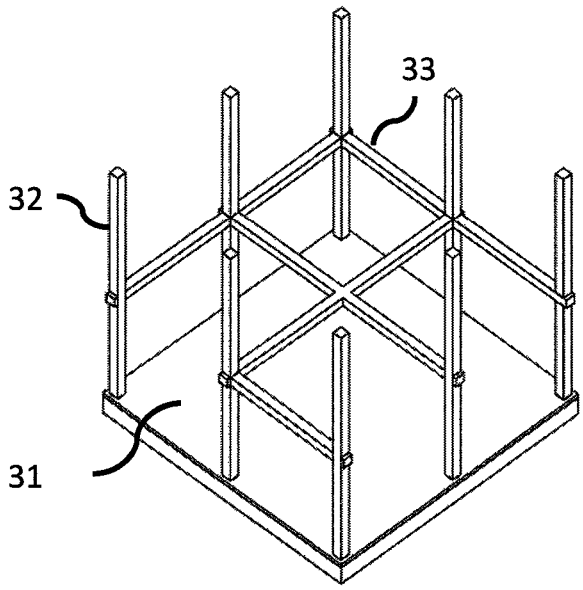
FIGS. 3*a* to 3*c* show perspective views during the assembly of a storage means according to a further embodiment example of the present invention.
Figure 3B:
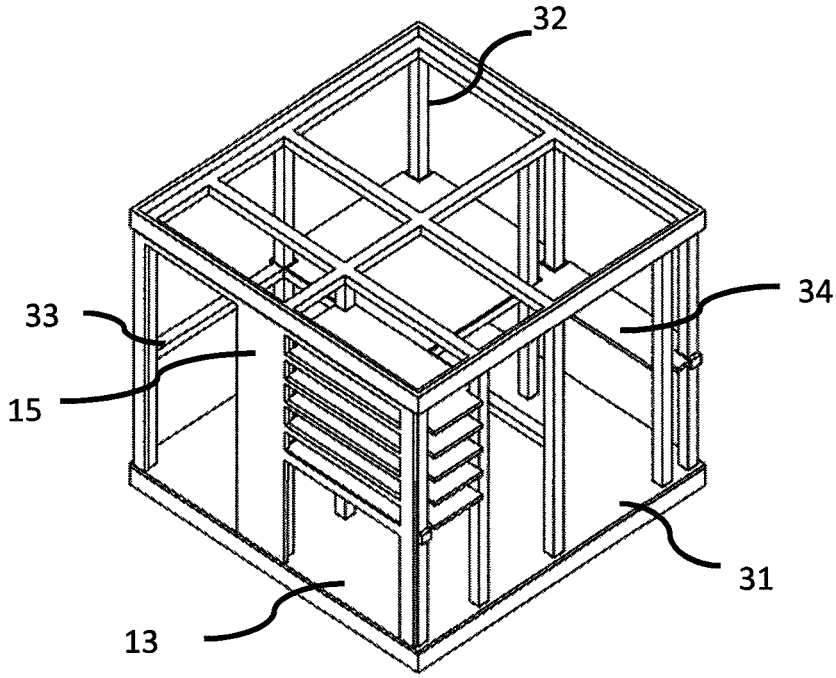
Figure 3C:
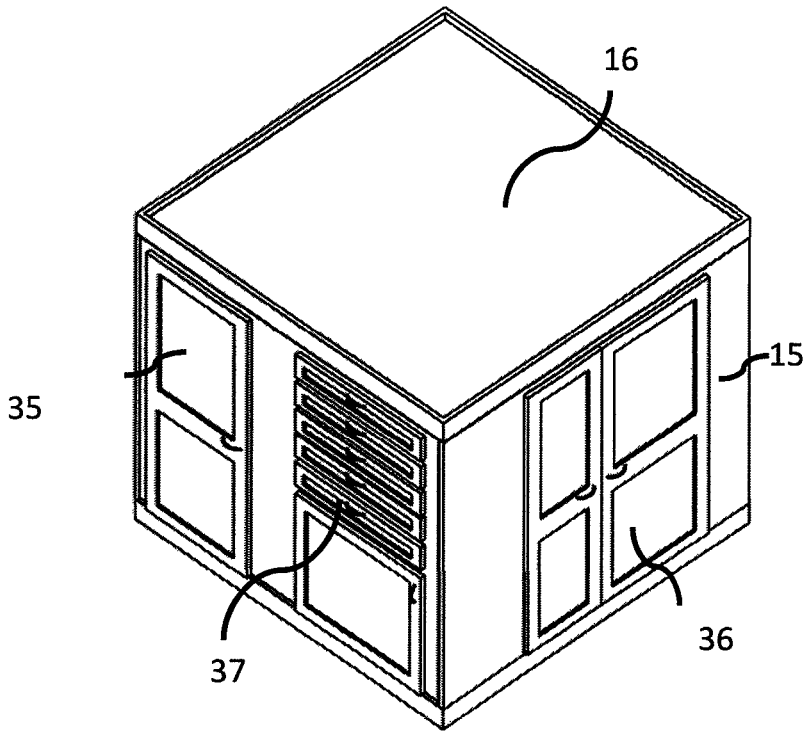

FIGS. 3*a* to 3*c* show perspective views of a storage means according to the invention during construction.

According to FIG. 3*a*, vertical support elements 32 are positioned on a base 31, which can be connected to horizontal support elements 33. The support elements 32 and 33 serve to stabilise the storage means. The support elements 32 and 33 can furthermore limit the holding compartments 11. If partition walls are provided as partition elements 14, the partition walls can be secured to the support elements 32 or 33. Support elements 32 and 33 arranged at the edge of the base 31 can also limit the extension of the opening sections 13, and the corresponding closing elements 12 can thus be fixed to the support elements 32 and 33.

FIG. 3*b* shows an interim stage in the assembly of the storage means from FIG. 3*a*. In FIG. 3*b*, some floors 34 of the different holding compartments 11 have been inserted. In addition, horizontal partition walls (not shown here) can be inserted as partition elements 14 in order to delimit the holding compartments 11 also in the horizontal direction.

FIG. 3*c* shows the storage means in the completed, assembled state, with the external surfaces of the storage means being formed by side walls 15, closing elements 12 and an upper side 16. The closing elements 12 comprise here a door 35, a double door 36 and fronts 37 of drawers.

An alternative to this monolithic structure in a further preferred embodiment example is the assembly of the storage means in modular form. This has the advantage that a user can combine individual modules to form larger units. For example, the user can select modules for a tool storage room, for a wheelbarrow, for skis and for a surfing board. Such modules can furthermore be assembled in a way that is simple and mobile. According to the invention, the modules each comprise at least one holding compartment 11, external surfaces, an opening section 13 and a closing element 12. Another advantage is that the modules can be easily connected to each other by mean of a plug-in system. In a special embodiment example, the modules and the holding compartments 11 can be adapted to the products of a certain manufacturer.

Figure 4:
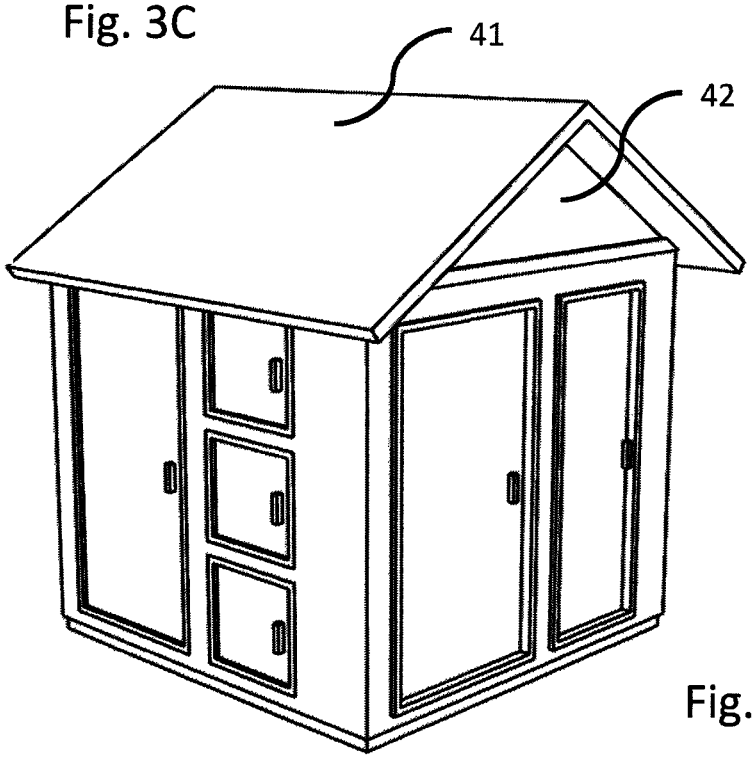
FIG. 4 shows a storage means according to a further embodiment example of the present invention.

In a further embodiment example according to FIG. 4, the upper side 16 of the storage means can be constructed as a gabled roof 41. The room 42 formed by the gabled roof 41 and the holding compartments 11 located below can be arranged as one or more holding compartments 11 with at least one slanted side surface. A corresponding closing element 12 can be arranged either on one of the slanted or on one of the vertical surfaces. Alternately, the room 42 under the gabled roof 41 can be open on both sides. The upper side 16 of the storage means can in other embodiment examples also be realised as pitched roof, pent roof, gabled roof or flat roof. The upper side 16 can furthermore be covered with, for example, shingles, tiles or roofing fabric, or be made of the same material as a section of a side wall 15 or a closing element 12. Additionally, solar panels or a solar system can be provided on the upper side 16 or also on a side wall 15. In FIG. 4, a side wall 15 has two opening sections 13, while a further side wall 15 has four. Several opening sections 13 can in this regard be assigned to one and the same holding compartment 11.

Figure 5:
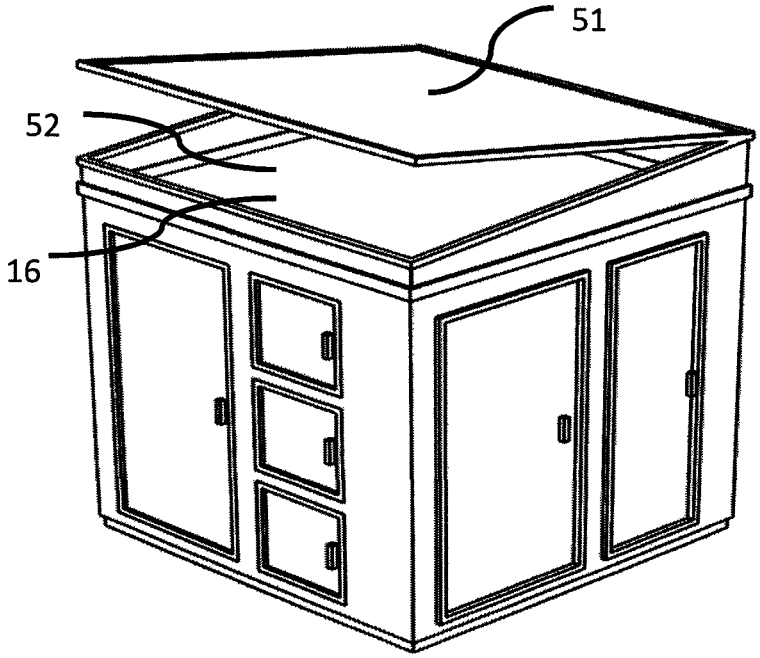
FIG. 5 shows a further storage means according to another embodiment example of the present invention.

FIG. 5 shows a further preferred embodiment example of the present invention. In FIG. 5, a room 52 is formed on the upper side 16 of the storage means that has only a slight height and whose upper side is open. The open upper side of the room 52 can be locked by a roof flap 51. The roof flap 51 is attached on one side wall of the room 52 by means of hinges or some similar device. The room 52 can be arranged in such a way that it can be used as a hotbed. The roof flap can for this purpose be made of a transparent material. In another embodiment example, the room 52 has no roof flap 51, and the room 52 is then open at the top. In this embodiment example, the room 52 can be arranged as a bed for plants or for roof greening. A storage means according to the present invention is preferably also provided with an electricity and water supply source, a tap or a water collection means. The water collection means can be realised as, for example, a rain drain without or without collection tank. The storage means can also be provided with an integrated garden hose that is linked to a water connection and can be drawn simply from the storage means. After it is used, the integrated garden hose can be rolled up again automatically by action of a pedal or a switch.

The storage means can also be provided with a cable connection means for winding an extension cable, which can be permanently connected to the electrical connection of an appliance. After it is used, only a foot pedal or a switch etc. has to be activated to start the cable connection means automatically rewinding the extension cable. This dispenses with the need for difficult and time-consuming winding of the cable, for example after the garden is mowed which in turn facilitates garden work. The cable connection means can also be designed in such a way that it releases cable under tensile pressure and rewinds the cable automatically again once the tensile pressure is relaxed; this avoids cable entanglement or danger from cables lying on the ground.

Figure 6:
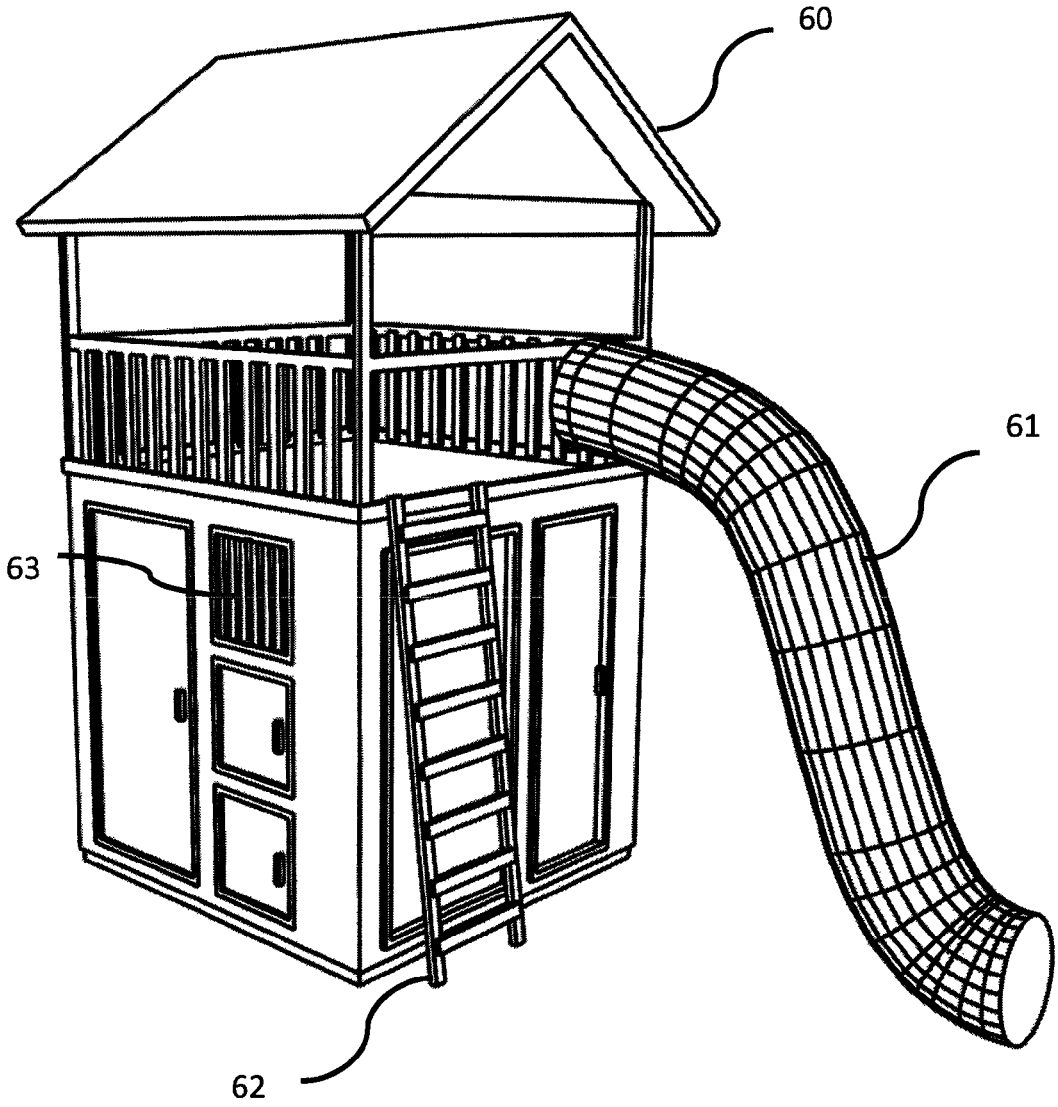
FIG. 6 shows a further storage means according to another embodiment example of the present invention.

FIG. 6 shows a further embodiment example of the present invention. In FIG. 6, the storage means has a play area. The play area 60 comprises one or more play devices 62, such as a slide, a climbing rope or playhouse. The play area 60 can be arranged on the upper side 16 of the storage means. A step-up means 62, such as a ladder or step ledge, can be provided on one side of the storage means. One of the holding compartments 11 of the storage means can furthermore be arranged as stall 63 for small animals.

In a further preferred embodiment example, the storage means can be locked by means of a central locking system. The central locking system closes at least two holding compartments 11 or all holding compartments 11 of the storage means and can be opened by entering a number combination or a password. The central locking system thus acts as central access control. This enables the holding compartments 11 to be opened quickly and easily without the need to open the different holding compartments 11 using different keys. Additionally or alternately, some of the holding compartments can also be provided with a local or decentralised locking system for the holding compartments 11 in question. This locking system provides security for the objects stored in the storage means and protects them from unauthorised access.

In a further preferred embodiment, a sound output system is provided that can be connected to an MP3 player. For example, the sound output system can also be provided with various interfaces for audio data media, a radio receiver, an integrated amplifier and weatherproof hi-fi loudspeakers for paying music etc.

Figure 7:
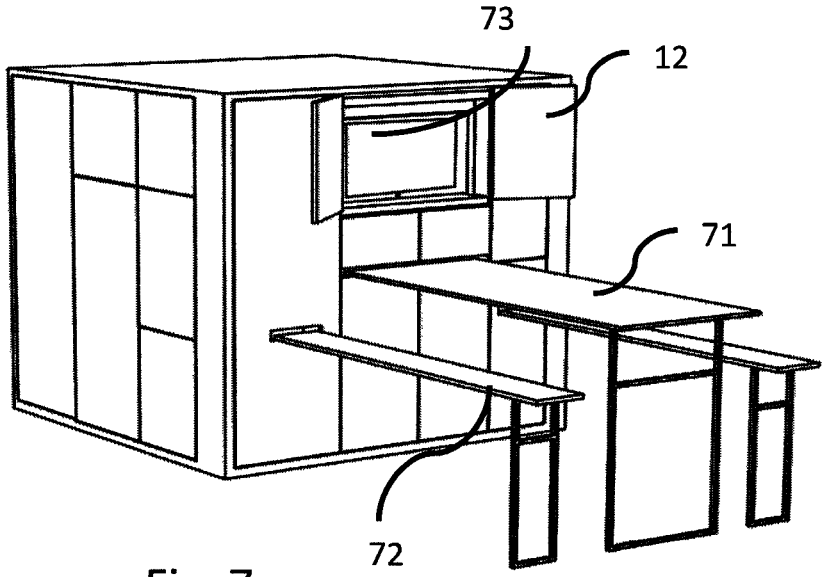
FIG. 7 shows a further storage means according to another embodiment example of the present invention with an insertible ale-bench set.

As is shown in FIG. 7, at least one seat element 72 and/or at least one table 71 can also be attached to the storage means. For example, an ale-bench set can be provided with slide-in function in one or more holding compartments 11. In a further holding compartment 11, a television 73 or a screen can also be installed, which allows outdoor football viewing. Alternately, the ale-bench set can be fixed vertically with fold-down movement in one or more of the holding compartments 11 by means of hinges or similar device. When required, the closing element 12 of the holding compartment 11, such as a door, can be opened and the ale-bench set folded out. Alternately, a garden seat can also be stored behind a folding door, with the garden seat being fixed with swivel movement around an axis along the backrest. The garden seat can also have an L-shape, with the backrest then forming the flap door, while the seating surface when the seat is in a folded state is stored in the holding compartment 11. Extra seating can thus be provided easily and quickly for garden parties, barbeques, etc.

The storage means according to the invention can additionally be provided with a lighting system that in the form of, for example, spotlights, solar lamps or colour LEDs can illuminate the environment. Doors and surfaces or surface sections of the storage means can in particular be made of translucent or partially transparent material, behind which a lighting source is positioned, so that the areas are lit up. In such a case, the storage means represents not only a space-saving alternative to a garden house but at the same time serves as a source for atmospheric lighting of the garden.

Figure 8:
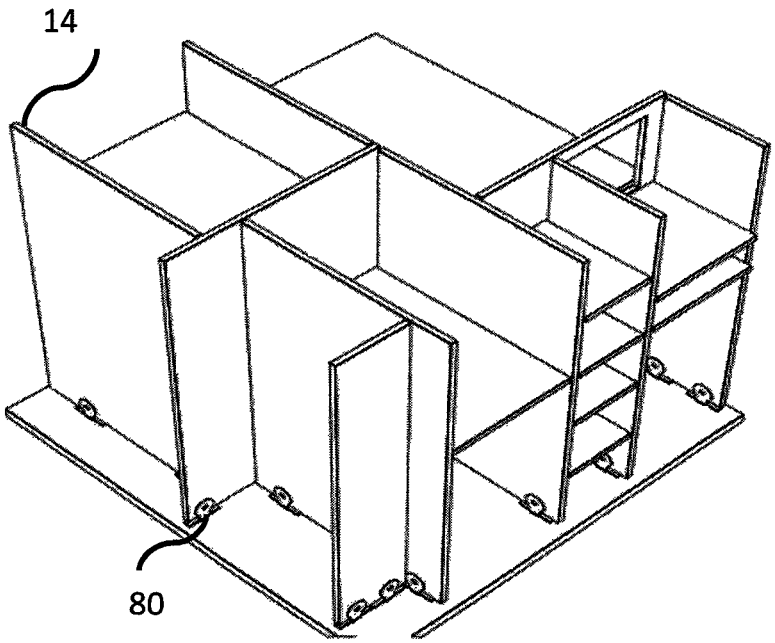
FIG. 8 shows a perspective view during the assembly of a storage means according to a further embodiment example of the present invention.

FIG. 8 shows a further possibility for the inner structure of the storage means according to the invention. Instead of support elements 32 and 33, mounting elements 80 are employed here for securing partition walls 14. In the embodiment example shown here, the mounting elements 80 are formed as a clamp-type elements similar to staples, and the partition walls 14 can accordingly be easily inserted. Depending on the materials used, the mounting elements 80 can be, for example, welded, bolted or nailed to the floor area. In order to fix the partition walls 14 in the mounting elements 80, the mounting elements 80 can be provided with a through-hole. A pin or a screw etc. can be inserted through the through-hole and the partition wall 14. The mounting elements 80 can furthermore have a base or similar element, so that the partition walls when inserted are at a distance from the floor area when the mounting elements 80 are attached. Further mounting elements 80 are possibly provided on side walls 15, partition walls 14 or on the upper side 16 of the storage means.

Figure 9A:
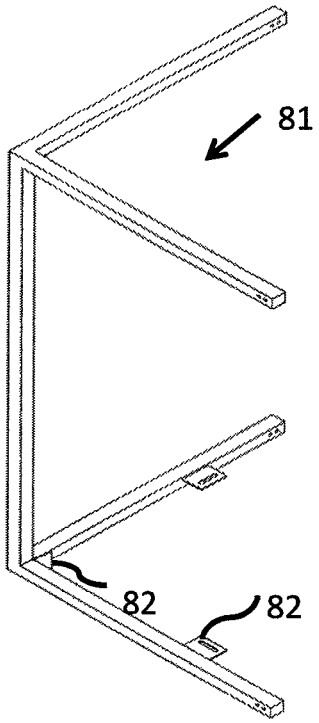
FIGS. 9*a* to 9*c* show perspective views during the assembly of a storage means according to a further embodiment example of the present invention.
Figure 9B:
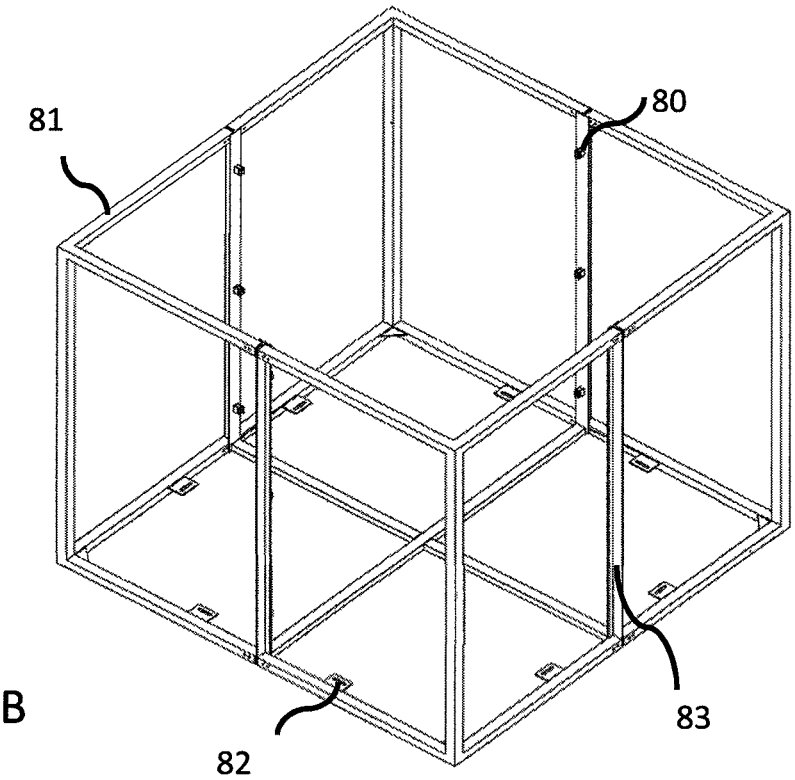
Figure 9C:
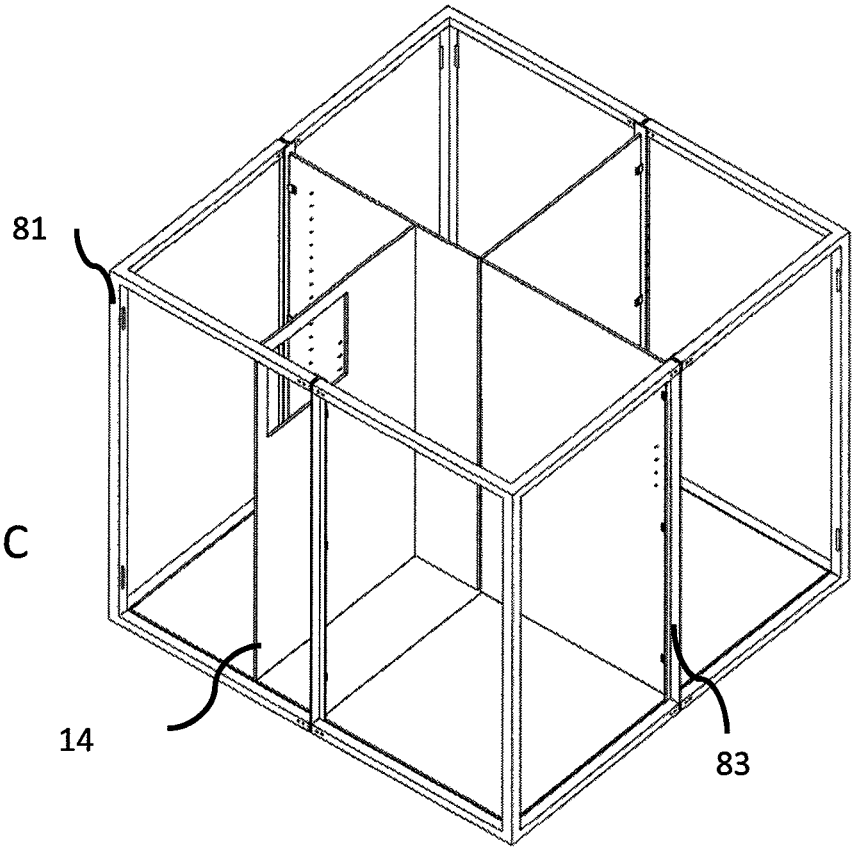

FIG. 9*a* shows a framework element 81 for stabilising the storage means. The framework element 81 has an upper and a lower L-shaped corner element and a rim element connecting the corner elements, leading to a form such as two rectangular trihedrons joined to each other or like a rectangular gable. The height of the rim element can here correspond to the length of a vertical external rim of the storage means. In this way, the framework element 81 can support a vertical external rim and two side walls 15 adjacent to this external rim. Support elements 82 can also be attached to the brackets of the corner elements in order to support a floor or ceiling plate. FIG. 9*b* shows an assembled framework consisting of four framework elements 81. To support the external rims of the storage means, the framework elements 81 are arranged such that two bracket ends of the corner elements come in contact with two neighbouring framework elements 81. The brackets of the neighbouring framework elements 81 can be joined together with a connecting element 83. As is shown in FIG. 9*b*, the connecting element 83 has the same length as the rim element of the framework elements 81, and two opposite bracket ends from one framework element 81 and two opposite bracket ends from a neighbouring framework element 81 can be jointed to the same connecting element 83. The connecting element 83 can be arranged linear or have a rectangular cross section. Alternately, the connecting element 83 can have a T-shaped cross section, as in FIG. 9*b*. In this case, the foot element of the connecting element 83 with T-shaped cross section extends between the bracket ends of the two neighbouring framework elements 81, while the corresponding traverse element lies on the brackets and can be fixed to this with screws or similar means (see FIG. 9*b*). The connecting element 83 can also in this way serve as delimitation of the opening section 13, for example as part of a door frame. In addition, mounting elements 80 can be provided on the connecting elements 83 in order to fix partition walls 14 to it (see FIG. 9*c*). This structure can be combined with any number of embodiment examples of the invention in order to achieve greater stability. Additionally or alternately to the mounting elements 80 grooves or recesses can be provided in the floor area and/or ceiling area of the storage means, into which the partition walls 14 can be inserted as required. The floor area and/or ceiling area can also be made up of several section elements. This allows simple replacement of section elements of the floor area and/or ceiling area, facilitating the restructuring or changing of partition walls. The individual parts are moreover more easily stored, transported and assembled.

With the wide choice of designs and materials, the storage means according to one of the embodiment examples of the present invention offers not only the possibility of storing objects securely while saving space, but can also be employed as an attractive screen.

The invention claimed is:

1. A tool shed for outdoor areas for storing tools and objects, the tool shed having a rectangular or square floor area surrounded by four outer sides, the tool shed comprising:

at least three holding compartments, each holding compartment has at least one closable opening section directed to one of the outer sides of the tool shed;

wherein the at least one opening section of a first and a second holding compartment of the at least three holding compartments and the at least one opening section of the second and a third holding compartment of the at least three holding compartments are arranged on adjacent outer sides of tool shed being rectangular to each other, respectively; and wherein the at least one opening section belonging to the same holding compartment of each of the three holding compartments has a surface that essentially corresponds to a surface of the outer side of this holding compartment, the at least one opening section of the first and the third holding compartment are arranged on opposing outer sides of the tool shed, wherein at least one holding compartment is accessible from separate opening sections on two non-adjacent outer sides of the tool shed, wherein all objects in a holding compartments are reachable from outside and access to all objects stored in the holding compartments is possible from outside the outer sides of the tool shed, wherein a width and height of one holding compartment is larger than the depth of this holding compartment.

2. A tool shed for outdoor areas for storing tools and objects, the tool shed having a rectangular or square floor area surrounded by four outer sides the tool shed comprising;

at least three holding compartments, each holding compartment has at least one closable opening section directed to one of the outer sides of the tool shed;

wherein the at least one opening section of a first and a second holding compartment of the at least three holding compartments and the at least one opening section of the second and a third holding compartment of the at least three holding compartments are arranged on adjacent outer sides of tool shed being rectangular to each other, respectively; and wherein the at least one opening section belonging to the same holding compartment of each of the three holding compartments has a surface that essentially corresponds to a surface of the outer side of this holding compartment, wherein the at least one opening section belonging to the same holding compartment of each of the three holding compartments and having a surface that essentially corresponds to the surface of the outer side of this holding compartment have one or more closing elements and can be opened by the one or more closing elements for storing and removing of objects, wherein said one or more closing elements belonging to the same holding compartment of each of the three holding compartments cover the entire surface of the outer side of this holding compartment, the at least one opening section of the first and third holding compartment, respectively, are arranged on opposing outer sides of the tool shed, wherein at least one holding compartment is accessible from separate opening sections on two non-adjacent outer sides of the tool shed, wherein all objects stored in the holding compartments are reachable from outside and access to all the objects stored in the holding compartments is possible from outside the outer sides of the tool shed, wherein at least one of the holding compartments s has opening sections on two different outer sides of the tool shed.

3. The tool shed according to claim 2, wherein horizontal elongations of the holding compartments parallel to an outer side of the tool shed basically correspond to a length of this outer side.

4. The tool shed according to claim 2, wherein the floor areas of the holding compartments of a horizontal intersecting plane together generally correspond to the floor area of the tool shed.

5. The tool shed according to claim 2, wherein the holding compartments of the tool shed generally fill completely the inner volume of the tool shed.

6. The tool shed according to claim 2, wherein at least two holding compartments positioned above each other and whose opening sections are arranged on the same outer side of the tool shed have different floor areas.

7. The tool shed according to claim 2, wherein a width and/or height of at least one holding compartment is larger than a depth of the at least one holding compartment.

8. The tool shed according to claim 2, wherein at least two holding compartments, whose opening sections are arranged on opposite outer sides of the tool shed are adjacent to each other at their rear sides.

9. The tool shed according to claim 2, wherein a left, a middle and a right outer sides of the tool shed have opening sections and a holding compartment, whose opening section is located on the middle outer side, extends between holding compartments, whose opening sections are positioned on the left and right outer side.

10. The tool shed according to claim 2, wherein horizontal and/or vertical support elements are arranged between the holding compartments.

11. The tool shed according to claim 2, wherein a horizontal distance between vertical support elements corresponds to a width orand a depth of at least one holding compartment, respectively.

12. The tool shed according to claim 2, wherein the tool shed can be assembled from modules and each module comprises at least one holding compartment.

13. The tool shed according claim 2, wherein partition walls are provided between the holding compartments that can be fixed by means of mounting elements to a floor area and/or to a side wall and/or to an upper side of the tool shed.

14. The tool shed according to claim 13, wherein the mounting elements have a U-shaped cross section.

15. The tool shed according to claim 13, wherein the partition walls are fixed with a distance to the floor area determined by the mounting elements.

16. The tool shed according to claim 2, wherein at least one of the holding compartments has opening sections on two different outer sides of the tool shed.

17. The tool shed according to claim 2, wherein the tool shed has a central locking system for a plurality of holding compartments and/or at least one local locking system for each holding compartment.

18. A tool shed for outdoor areas for storing tools and objects, the tool shed having a rectangular or square floor area surrounded by four outer sides, the tool shed comprising:

at least three holding compartments, each holding compartment has at least one closable opening section directed to one of the outer sides of tool shed;

wherein the at least one opening section of a first and a second holding compartment of the at least three holding compartments and the at least one opening section of the second and a third holding compartment of the at least three holding compartments are arranged on adjacent outer sides of tool shed being rectangular to each other, respectively; and wherein the at least one opening section belonging to the same holding compartment of each of the three holding compartments has a surface that essentially corresponds to a surface of the outer side of this holding compartment, the at least one opening section of the first and the third holding compartment are arranged on opposing outer sides of the tool shed, wherein at least one holding compartment is accessible from separate opening sections on two non-adjacent outer sides of the tool shed, wherein all objects in a holding compartments are reachable from outside and access to all objects stored in the holding compartments is possible from outside the outer sides of the tool shed, wherein left, middle and right outer sides of the tool shed have opening sections and a holding compartment, whose opening section is located on the middle outer side, extends between holding compartments, whose opening sections are positioned on the left and right outer sides.

* * * * *